US005855274A

United States Patent [19]

Piao

[11] Patent Number: 5,855,274

[45] Date of Patent: Jan. 5, 1999

[54] TOOL KIT ASSEMBLY

[76] Inventor: Tseng Sen Piao, P.O. Box 82-144, Taipei, Taiwan

[21] Appl. No.: 986,416

[22] Filed: Dec. 8, 1997

[51] Int. Cl.[6] ..... B65D 73/00

[52] U.S. Cl. ..... 206/373; 206/472; 206/373; 206/478

[58] Field of Search ..... 206/349, 372, 206/373, 234, 481, 745, 756, 765, 472, 473, 478; 211/70.6; 220/410

[56] References Cited

U.S. PATENT DOCUMENTS

| | | | |
|---|---|---|---|
| 2,139,293 | 10/1938 | Wallgren | 206/373 |
| 4,836,374 | 6/1989 | Hutchins et al. | 206/373 |
| 5,515,969 | 5/1996 | Schonenbach | 206/373 |

FOREIGN PATENT DOCUMENTS

| | | | |
|---|---|---|---|
| 2584332 | 1/1987 | France | 211/70.6 |
| 1163809 | 9/1969 | United Kingdom | 206/373 |

*Primary Examiner*—Paul T. Sewell
*Assistant Examiner*—Jila Mohandesi
*Attorney, Agent, or Firm*—A & J

[57] ABSTRACT

A tool securing plate assembly with adjustable and replaceable tool securing means including inter-connected tool securing plates, retaining strips, and elastic bands. The tool securing plates are provided with arrays of spaced round through holes. The elastic bands are secured to the tool securing plates by means of the retaining strips. The retaining strips include projections at both sides for engaging the round through holes, a projecting block disposed in the middle for pressing against the elastic band, and a triangular non-skid tooth at the middle of the projecting block for pressing the elastic band deeper into the round through holes so as to firmly secure the elastic bands on the tool securing plates. The elastic bands are adjustable at one end. The tool securing plate assembly can be adapted for use in tool kits or bag type tool kits or suspended on the walls.

1 Claim, 8 Drawing Sheets

TOOL KIT ASSEMBLY

BACKGROUND OF THE INVENTION

1. Field of the Invention

The present invention relates to a tool kit assembly, and more particularly to a tool kit assembly in which the tool securing means are replaceable and adjustable to allow easy placement of tools of various specifications.

2. Field of the Invention

The conventional tool bag is generally comprised of a leather covering, a lining covered on the leather covering on the inside, a cardboard retained on the inside between the leather covering and the lining, two elastic bands respectively fastened to the lining with stitches at different locations and adapted for holding down hand tools, and a zip fastener fastened to the lining around the border area and adapted for closing the lining and the leather cover into a bag. This structure of tool bag has drawbacks. Because the manufacturing process of this structure of tool bag consumes much labor, its manufacturing cost is high. Another drawback of this structure of tool bag is the short service life of the elastic bands. Because the elastic bands wear out quickly with use, the service life of the tool bag is short. Furthermore, because the elastic bands are fixedly secured to the lining with stitches, they are not replaceable when they lose their elastic material property.

Therefore, it is an object of the present invention to provide an improved tool kit assembly which can obviate and mitigate the above-mentioned drawbacks.

SUMMARY OF THE INVENTION

The present invention relates to a tool kit assembly, and more particularly to a tool kit assembly in which the tool securing means are replaceable and adjustable to allow easy placement of tools of various specifications.

A primary object of the present invention is to provide a tool securing plate assembly that has adjustable and replaceable securing means and that can be suspended on the wall.

Another object of the present invention is to provide a tool kit assembly in which tool securing plates with adjustable and replaceable securing means are disposed therein for keeping tools of various specifications neatly and conveniently.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numberals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
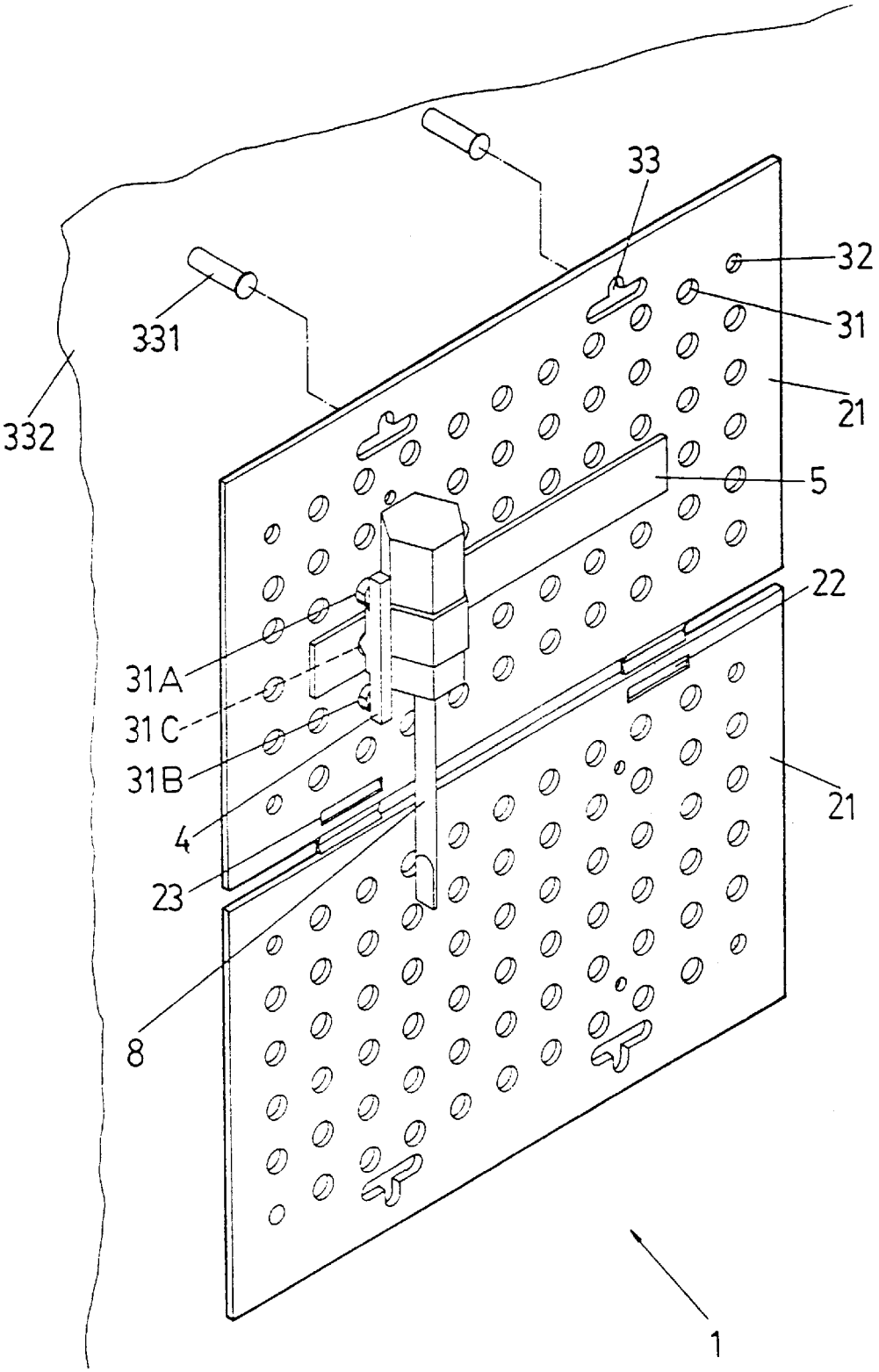
FIG. 1 is a perspective assembled view of an embodiment of the present invention adapted to be suspended on a wall.
Figure 2:
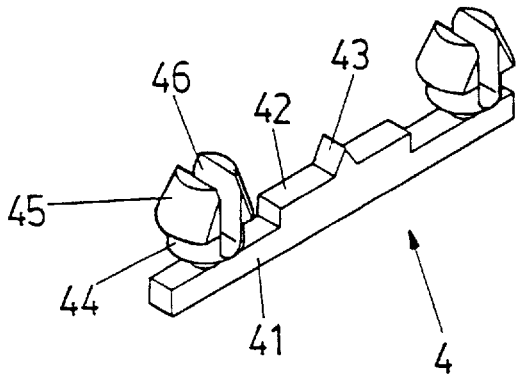
FIG. 2 is a perspective view of the retaining strip of the present invention.
Figure 3A:
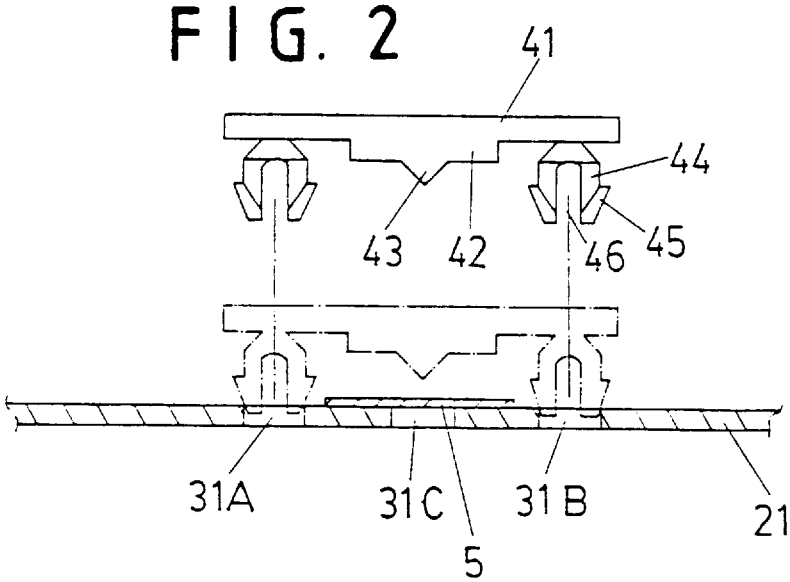
FIG. 3A is a plan sectional view showing assembly of the retaining strip of the invention to the tool securing plate.
Figure 3B:
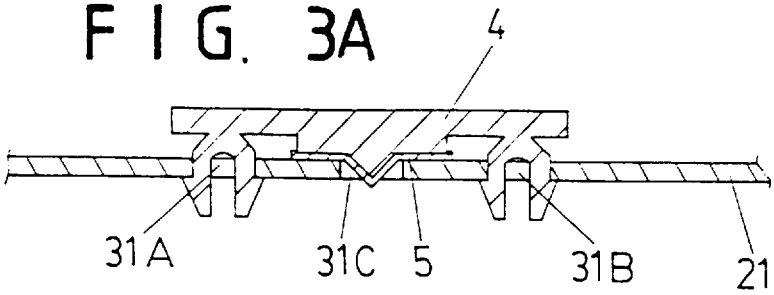
FIG. 3B is a plan sectional view of the retaining strip in FIG. 3A secured to the tool securing plate.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

With reference to FIGS. 1, 2, 3A and 3B, the present invention comprises a tool securing plate body 1 including two tool securing plates 21 connected by fastening elements 22 and 23; retaining strips 4; and elastic bands 5. The two tool securing plates 21 form upper and lower securing surfaces by means of the fastening elements 22 and 23. Butterfly holes 33 may be provided at one side of each tool securing plate to suspend the tool securing plate body 1 on a nail 331 on a wall 332. At the four corners of each tool securing plate there are provided round engaging holes 32 for matching umbrella-shaped posts 61 of a tool kit 6. There are also provided arrays of spaced round through holes 31. The retaining strip 4 may be retained in round through holes 31A, 31B and 31C, and includes an umbrella-shaped projection 44 at either end. When the projections 44 engage the round through holes 31A and 31B, a projecting block 42 intermediate the projections 44 presses against the elastic band 5, and a triangular non-skid tooth 43 at the middle of the projecting block 42 presses the elastic band 5 deeper into the round through hole 31C in the middle, so that the elastic band 5 is firmly secured on each tool securing plate 21. The position of one end of the elastic band 5 is freely adjustable. Another retaining strip 4 may further be used to define a clamping hole 51 adapted for receiving a tool such as a screwdriver 8. In this way the tool securing plate 21 may be adapted for receiving different tools of different specifications. Besides, the round through holes 31 may be configured to be equi-distant transversely or longitudinally so as to allow arrangement of the retaining strips in a transverse or longitudinal manner.

Figure 4:
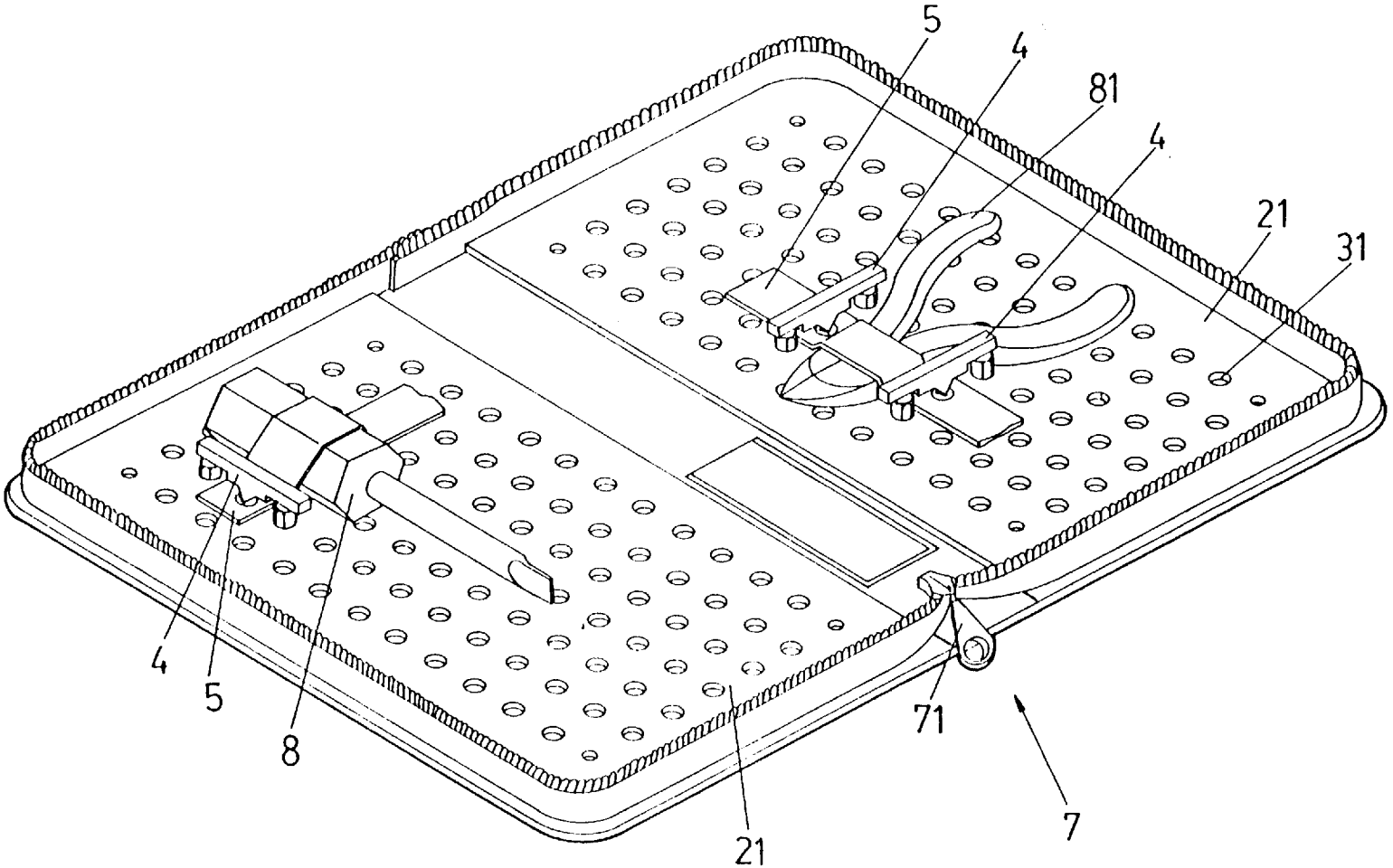
FIG. 4 is a schematic view of the present invention adapted for use in a bag type tool kit.

Referring to FIG. 4, which shows the tool securing plate of the invention sewn to a bag type tool kit, the tool securing plates 21 are disposed inside a foldable bag 7 and are secured thereto by stitches. The bag 7 is further provided with a zipper 71 which is used to close or open the bag 7.

Figure 5:
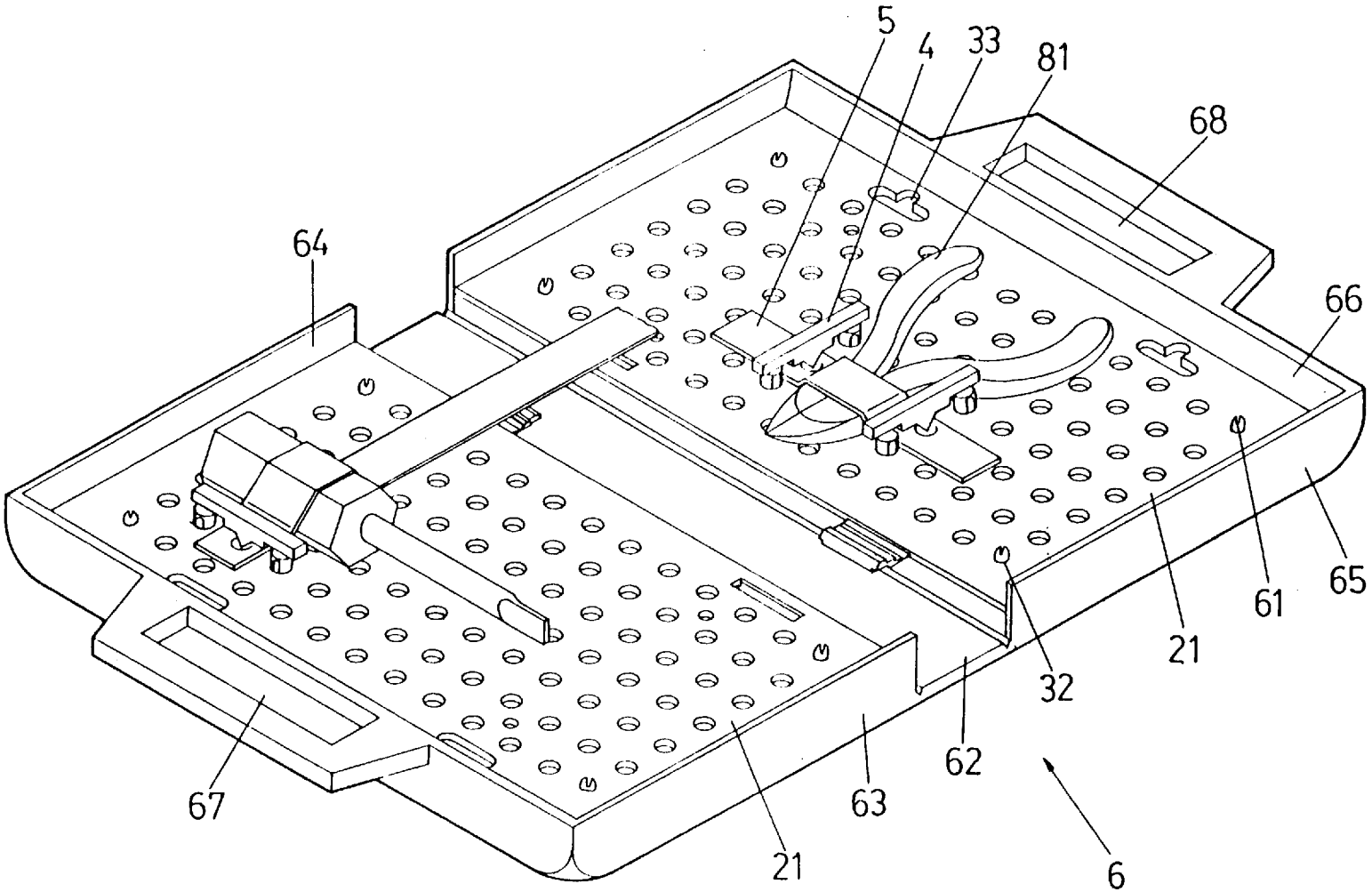
FIG. 5 is a schematic view of the present invention adapted for use in a tool kit.
Figure 6:
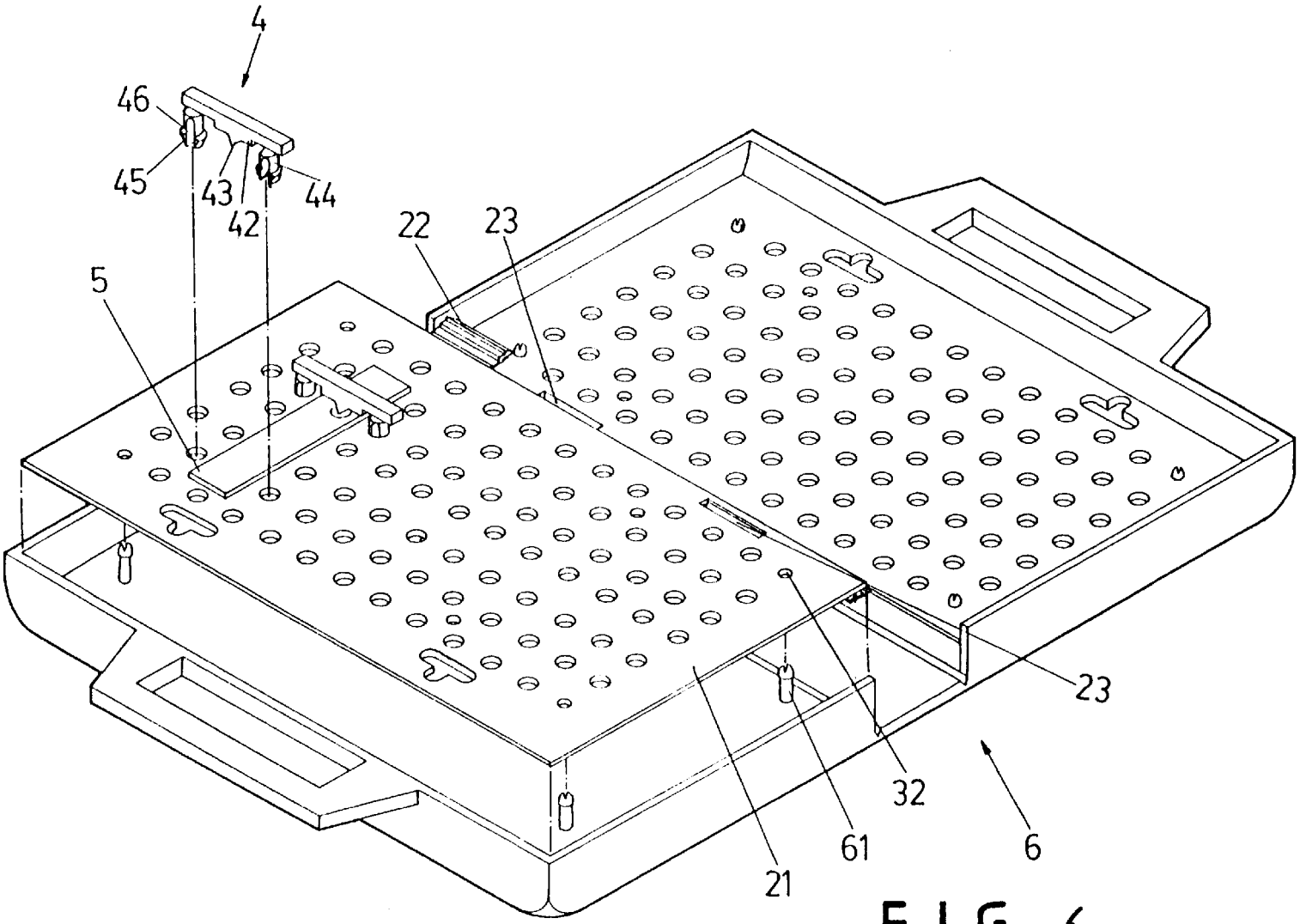
FIG. 6 is a perspective exploded view of a tool kit assembly according to the present invention.

With reference to FIGS. 5 and 6, the present invention is adapted for use in a tool kit. A took kit 6 includes two kit portions 63 and 65 connected by a thin connecting band 62. The kit portions 63 and 65 define respective receiving spaces 64 and 66, which are provided with umbrella-shaped posts 61 for matching and engaging the round engaging holes 32 at four corners of the tool securing plates 21. The kit portions 63 and 65 are respectively provided with a handle portion 67, 68 at one side thereof so that the two hand portions 67 and 68 together constitute a handle for carrying purposes.

Figure 7:
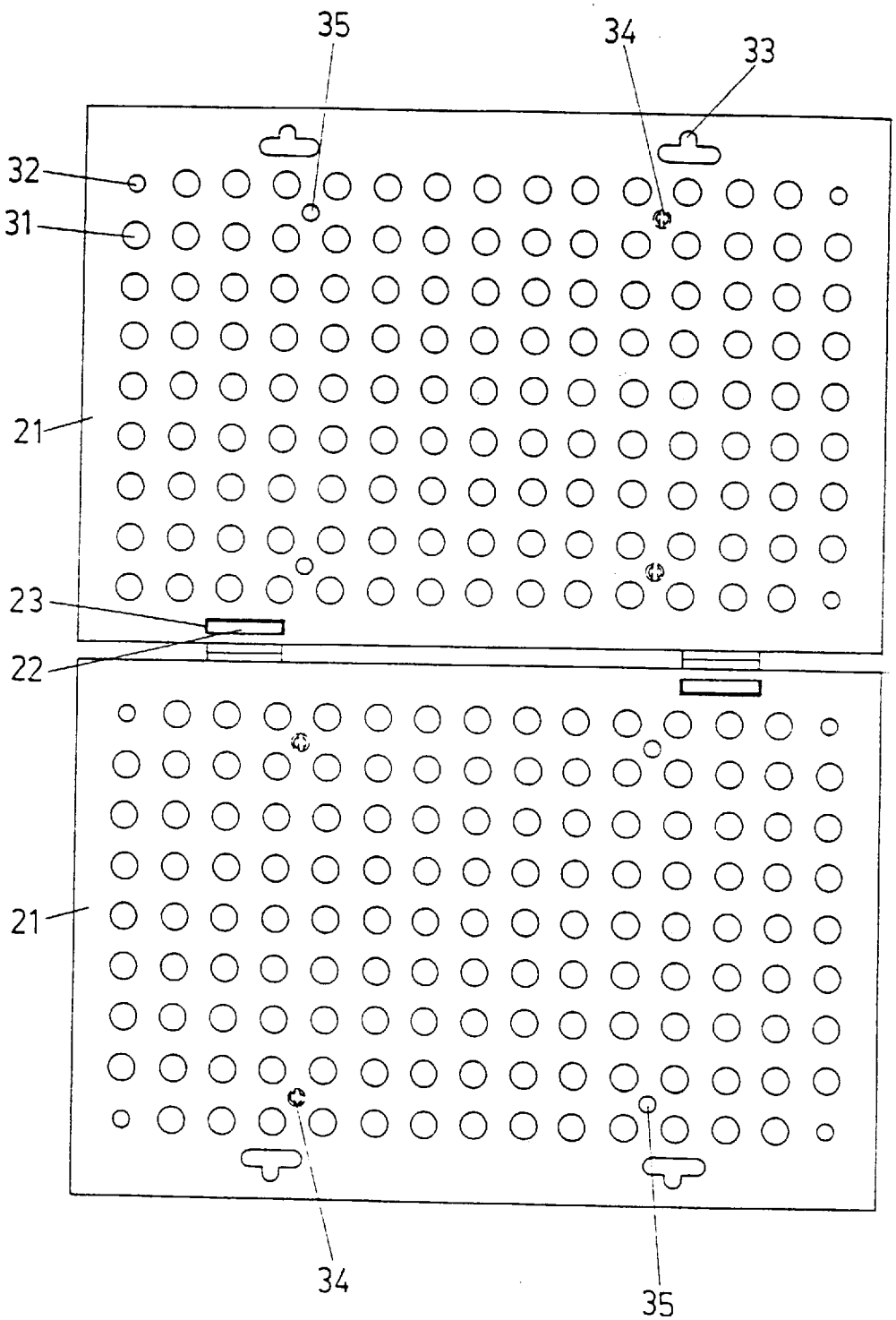
FIG. 7 is a schematic plan view of the upper surfaces of the tool securing plates of the present invention.
Figure 8A:
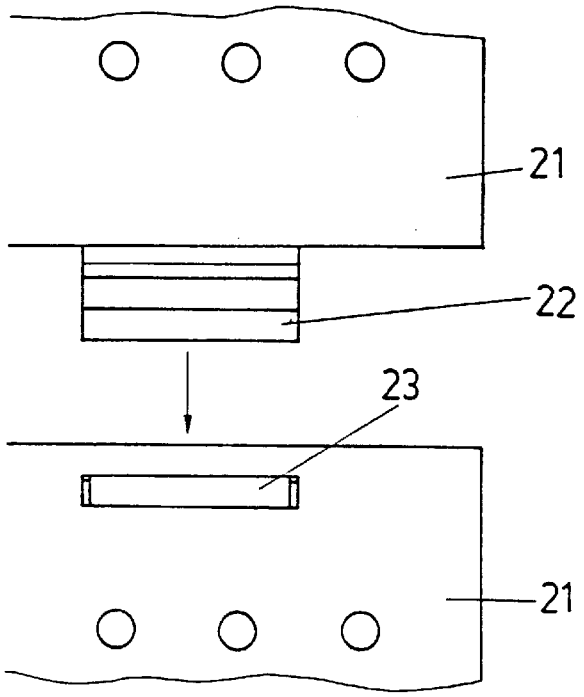
FIGS. 8A, 8B, 8C and 8D illustrate connection of the tool securing plates.
Figure 8C:
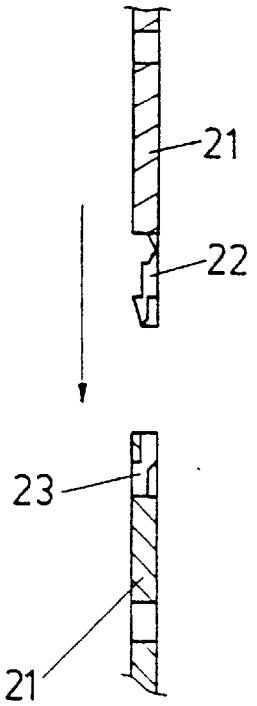
Figure 8B:
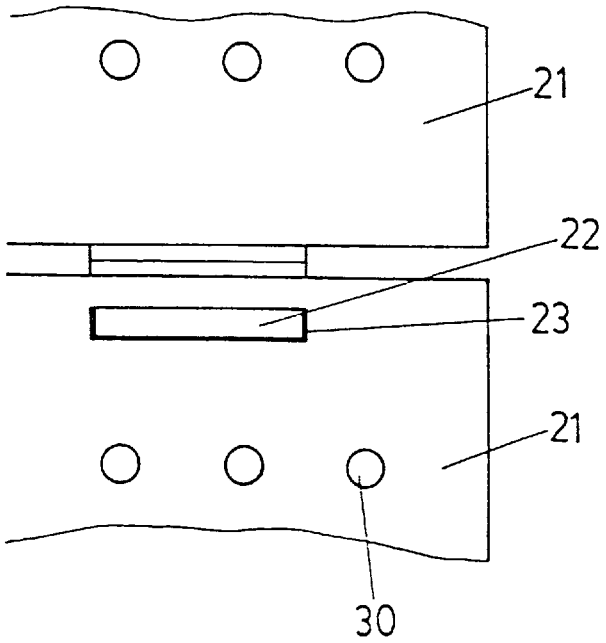
Figure 8D:
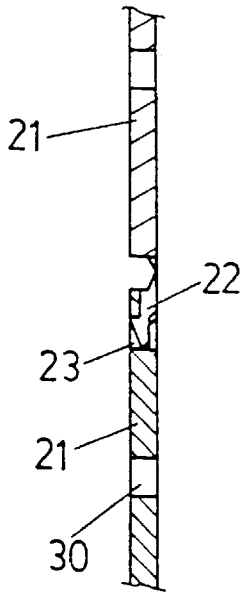

Referring to FIG. 7, the two tool securing plates 21 are connected to form the tool securing plate body 1 by means of the fastening elements 22 and 23. The butterfly holes 33 allow the tool securing plates 21 to be secured on the wall 332 to be used as a securing plate. They can also be folded to the back such that the engaging pins 34 of one plate engage the through holes 35 of other plate to allow placement of tools on both sides of the tool securing plate body 1 of the present invention.

Referring to FIGS. 8A, 8B, 8C and 8D which illustrate embodiments of the fastening elements 22 and 23, the tool securing plates 21 are respectively provided with an engaging plate 22 and an engaging slot 23 located at corresponding positions. When the two tool securing plates 21 are connected (see FIG. 8A), the engaging plate 22 is aligned with the engaging slot 23 and is pressed inwardly to accomplish the engagement (see FIG. 8B).

Figure 9A:
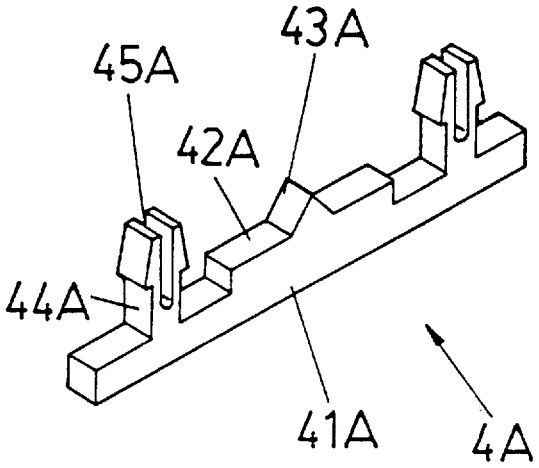
FIG. 9A is a perspective view of another embodiment of the retaining strip of the present invention.
Figure 9B:
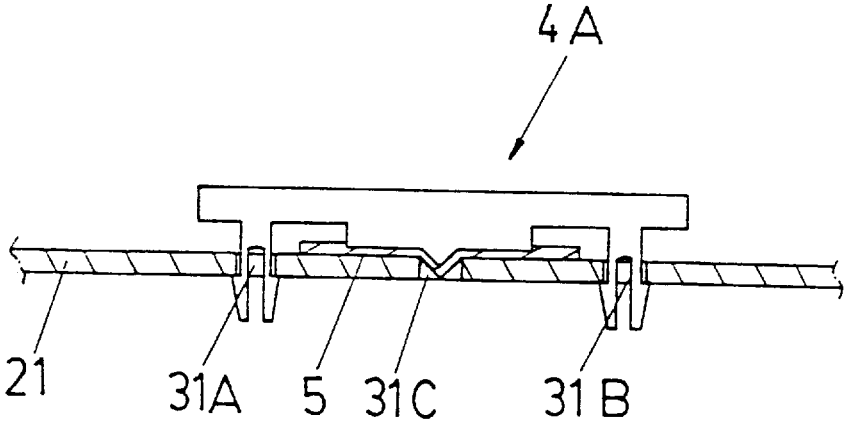
FIG. 9B is a sectional view of the retaining strip of the tool securing plate.

Referring to FIGS. 9A and 9B, which show another embodiment of the retaining strip. A retaining strip 4A has a retaining arm 41A with square projections 44A at both sides thereof. Each projection 44A has a recess 45A in the middle for mounting on the round through holes 31A and 31B of the tool securing plates 21. When it is desired to remove the retaining strip 4, the projections 44A may be pressed with the thumb and the index finger so that the space of the recess 45A is reduced to allow removal of the retaining strip from the round through holes. Likewise, the projecting block 42 at the middle is provided for pressing against the elastic band 5 on the tool securing plates 21 and the triangular non-skid tooth 43A is provided to press the elastic band 5 deeper into the round through hole 31C so as to more firmly hold the elastic band 5 on the tool securing plates 21.

In summary, the tool securing plates of the present invention can be used independently or in combination with tool kits or bags. Furthermore, the positions of the elastic bands can be adjusted. The detachable elastic bands and the retaining strips allow placement of tools in various ways.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A tool kit assembly with adjustable and replaceable securing means, comprising:

a tool kit having two kit portions and a connection portion intermediate said kit portions to allow said tool kit to be foldable or openable, said kit portions having raised walls at three sides thereof, each kit portion defining within said raised walls thereof a recess the four corners of which are provided with umbrella-shaped posts;

two tool securing plates, each having butterfly holes at one side and round engaging holes at four corners thereof for matching said posts of said kit portions, each further having arrays of equi-distantly spaced round through holes, said tool securing plates being connected by fastening elements to form a large securing plate surface;

elastic bands secured on said tool securing plates; and a plurality of retaining strips, each having umbrella-shaped projections at both sides thereof for engaging said round through holes of said tool securing plates, a projecting block intermediate said projections for pressing against said elastic bands on said tool securing plates, and a triangular non-skid tooth at the middle of said projecting block adapted to press said elastic bands deeper into the corresponding round through holes so that said elastic bands may be firmly secured on said tool securing plates.

* * * * *